US010151427B2

(12) United States Patent
Mattson

(10) Patent No.: US 10,151,427 B2
(45) Date of Patent: Dec. 11, 2018

(54) OVERHEAD MOUNTABLE STORAGE SYSTEM

(71) Applicant: Lee Mattson, Las Vegas, NV (US)

(72) Inventor: Lee Mattson, Las Vegas, NV (US)

( * ) Notice: Subject to any disclaimer, the term of this patent is extended or adjusted under 35 U.S.C. 154(b) by 0 days.

(21) Appl. No.: 14/947,404

(22) Filed: Nov. 20, 2015

(65) Prior Publication Data

US 2017/0146188 A1 May 25, 2017

(51) Int. Cl.

| | |
|---|---|
| ***F16M 13/02*** | (2006.01) |
| ***A47B 81/00*** | (2006.01) |
| ***A47B 43/00*** | (2006.01) |
| *A47F 5/08* | (2006.01) |

(52) U.S. Cl.

CPC ..... *F16M 13/027* (2013.01); *A47B 43/003* (2013.01); *A47B 81/00* (2013.01); *A47F 5/08* (2013.01)

(58) Field of Classification Search

CPC .... F16M 13/027; A47B 81/00; A47B 43/003; A47F 5/08; A47F 5/0838; A47F 5/0846

USPC ..... 52/39, 36.4, 36.5; 248/317, 324; 211/113, 118, 162, 175, 86.01, 94.01; 312/245

See application file for complete search history.

(56) References Cited

U.S. PATENT DOCUMENTS 1,960,607 A * 5/1934 Wallace ..... D06F 53/04 211/119.01
2,607,518 A * 8/1952 Cohen ..... B60N 3/002 220/592.2
2,909,355 A * 10/1959 Nelson ..... E04B 9/18 110/111
3,558,091 A * 1/1971 Bush ..... E04B 9/16 248/317
4,122,762 A * 10/1978 Williams ..... E04B 9/12 248/343
4,276,959 A * 7/1981 Barber ..... B63C 5/02 182/136
4,446,660 A * 5/1984 Miller ..... A47B 81/002 248/250
4,549,375 A * 10/1985 Nassof ..... E04B 9/005 52/39
4,738,369 A * 4/1988 Desjardins ..... F16M 11/28 211/113

(Continued)

*Primary Examiner* — Jonathan Liu
*Assistant Examiner* — Devin Barnett
(74) *Attorney, Agent, or Firm* — FisherBroyles, LLP; Rob L. Phillips

(57) ABSTRACT

A storage system mountable to a ceiling or other overhead structure. The system having at least two support rails attachable to an overhead member; and at least two storage unit receiving track members configured to movably attach to the at least two support rails in a spaced relationship, the at least two storage unit receiving track members each having a side ledge configured to receive and support an opposite upper portion of one or more storage units comprising a container and lid member wherein opposite upper portions extend into oppositely facing side ledges of the at least two storage unit track members when movably attached to the at least two support rails. A bucket receiving member slidably inserts into the side ledges of the at least two storage unit receiving track members wherein the bucket receiving member is configured to retain buckets such as the ubiquitous 10 gallon bucket.

6 Claims, 13 Drawing Sheets

(56) References Cited

U.S. PATENT DOCUMENTS 4,830,199 A * 5/1989 Wolfe ..... A47F 5/0031 211/113
5,104,079 A * 4/1992 Hardtke ..... F16B 2/06 248/228.5
5,285,602 A * 2/1994 Felton ..... A47B 96/1416 52/127.2
5,402,979 A * 4/1995 Bellamy ..... B60R 11/00 182/127
5,584,624 A * 12/1996 DeVoursney ..... A47B 47/027 211/162
5,713,157 A * 2/1998 van Leeuwen ..... E04B 9/006 248/201
5,957,585 A * 9/1999 Dabrowski ..... E04D 13/064 211/162
5,960,967 A * 10/1999 Neil ..... A47F 5/0846 211/94.01
6,145,678 A * 11/2000 Morrison ..... A47B 53/00 211/113
6,754,992 B1 * 6/2004 Byfield ..... E04B 1/2403 403/205
7,604,131 B1 * 10/2009 Clark ..... B62H 3/12 211/118
7,895,955 B2 * 3/2011 Ferder ..... A47B 43/003 108/149
8,371,458 B2 * 2/2013 Yu ..... A47B 43/006 108/149
8,511,929 B2 * 8/2013 Raye ..... B60T 7/20 248/220.22
8,661,739 B2 * 3/2014 Keenan ..... A47B 96/00 108/149
8,782,962 B1 * 7/2014 Schoewe ..... A47B 88/402 52/27
9,038,344 B2 * 5/2015 Mayer ..... E04B 9/366 52/220.6
2002/0063102 A1 * 5/2002 Hanneken ..... A47F 5/0892 211/113
2003/0046890 A1 * 3/2003 Lynch ..... B32B 3/266 52/506.07
2004/0226899 A1 * 11/2004 Ferron ..... B62H 3/12 211/17
2006/0021929 A1 * 2/2006 Mannheim ..... B01D 61/18 210/321.6
2007/0007223 A1 * 1/2007 Thrush ..... A47B 96/14 211/118
2007/0158286 A1 * 7/2007 Beurer ..... A47B 53/02 211/113
2008/0036341 A1 * 2/2008 Nilsen ..... A47F 5/0892 312/246
2008/0230499 A1 * 9/2008 Jasniy ..... A47F 5/0892 211/119
2008/0245753 A1 * 10/2008 Spriegel ..... A47F 5/0807 211/85.7
2009/0065524 A1 3/2009 Richardson et al.
2010/0025348 A1 * 2/2010 Burgess ..... A47F 5/0056 211/113
2011/0186533 A1 * 8/2011 Thrush ..... A47F 5/08 211/113
2011/0265393 A1 * 11/2011 Mass ..... F16M 13/02 52/39
2012/0175331 A1 * 7/2012 Yu ..... A47B 43/006 211/119
2012/0181240 A1 * 7/2012 Crowley ..... A47B 43/003 211/26
2012/0292475 A1 * 11/2012 Wronski ..... F21V 21/048 248/323
2013/0087673 A1 * 4/2013 Mullins ..... F16M 13/027 248/343
2013/0199016 A1 8/2013 Found
2014/0263866 A1 * 9/2014 Hemmer ..... F16M 13/00 248/58
2014/0299730 A1 * 10/2014 Green ..... F16M 13/022 248/317
2015/0069892 A1 * 3/2015 Schneider ..... F16M 13/027 312/245
2016/0198843 A1 * 7/2016 Newman ..... A47B 55/02 206/577

* cited by examiner

OVERHEAD MOUNTABLE STORAGE SYSTEM

FIELD OF THE INVENTION

The embodiments of the present invention relate to a storage system mountable to a ceiling or other overhead structure.

BACKGROUND

Storage space is often limited in garages due to the fact that individuals desire to park items such as, automobiles, recreational vehicles, boats and the like in garages and other enclosed storage spaces. Accordingly, much of the garage and storage space is occupied by these vehicles and not useful for storage. It is therefore desirous to maximize the utilization of space surrounding the automobiles and other items as mentioned previously, as well as other floor-space and wall-space occupying items. The space above all of these type items is one area of premium suitability for storage if a properly constructed structure is in place.

It would be advantageous to develop a storage system installable on a ceiling or other overhead structure. It would be particular advantageous if the storage system is useable in a garage and other storage spaces if such that the space above automobiles and other type mentioned items is available for storage.

SUMMARY

One embodiment of the present invention is directed to a system comprising broadly at least two support rails attachable to an overhead member; and at least two storage unit receiving track members configured to movably attach to said at least two support rails in a spaced relationship, said at least two storage unit receiving track members each having a side ledge configured to receive and support an opposite upper portion of one or more storage units comprising a container and lid member wherein opposite upper portions extend into oppositely facing side ledges of said at least two storage unit receiving track members when movably attached to said at least two support rails.

In one embodiment, a bucket receiving member is configured to slidably insert between two storage unit receiving track members for support by said side ledges. Said bucket receiving member is further configured to retain buckets such as the ubiquitous 10 gallon bucket. In one embodiment, the bucket receiving member acts as a clamp about an upper portion of the bucket. The bucket receiving member may accommodate buckets from 1 to 10 gallons or more.

Advantageously, the support rails and storage unit receiving track members are designed such that the storage unit receiving track members may be attached to said support tracks in an angled manner relative to said support rails. Such a relationship is more versatile than a simple orthogonal relationship.

Other variations, embodiments and features of the present invention will become evident from the following detailed description, drawings and claims.

DETAILED DESCRIPTION

Figure 1A:
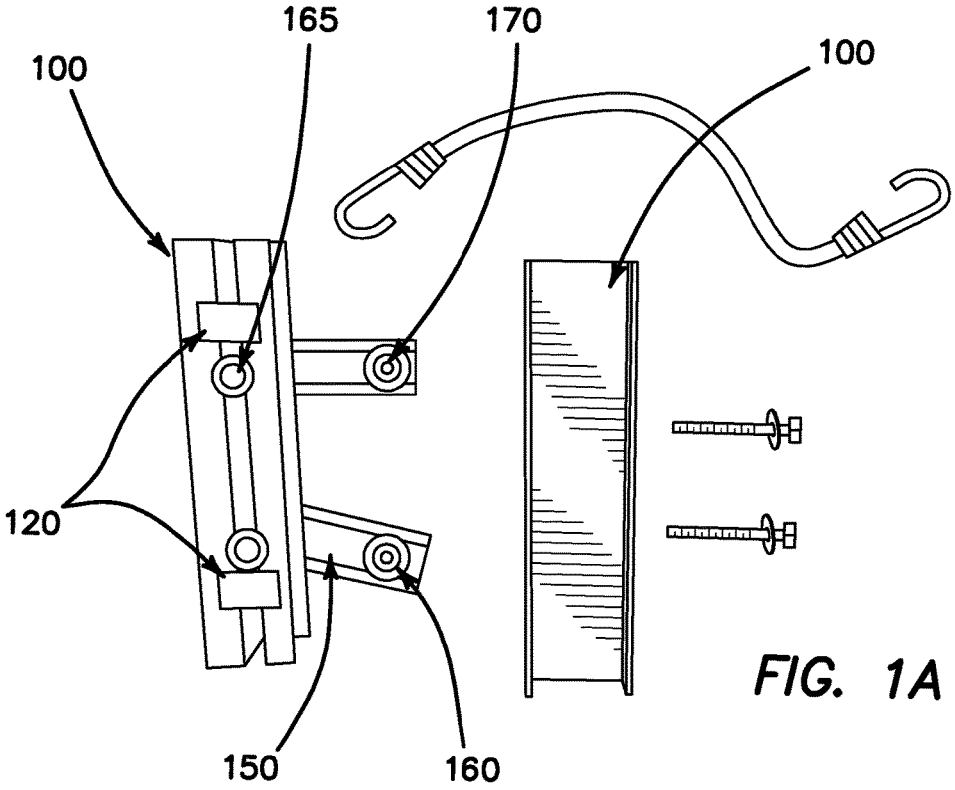
FIGS. 1A-1D illustrate storage unit receiving track members according to the embodiments of the present invention.
Figure 1B:
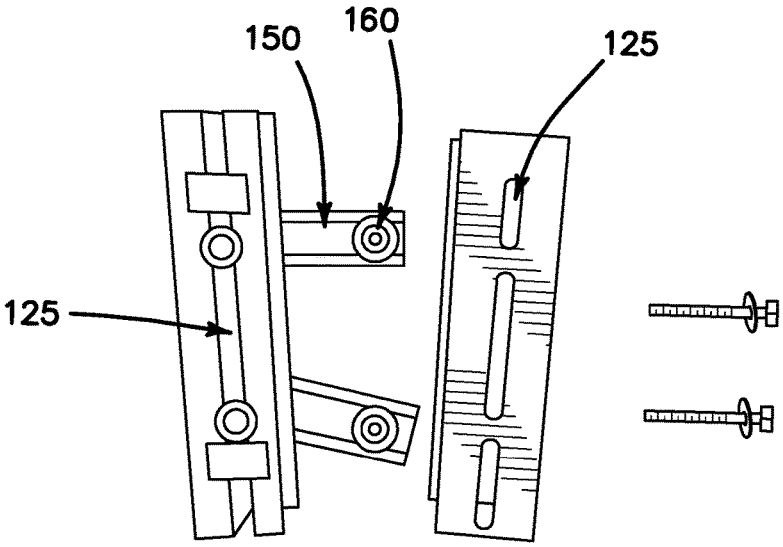
Figure 1C:
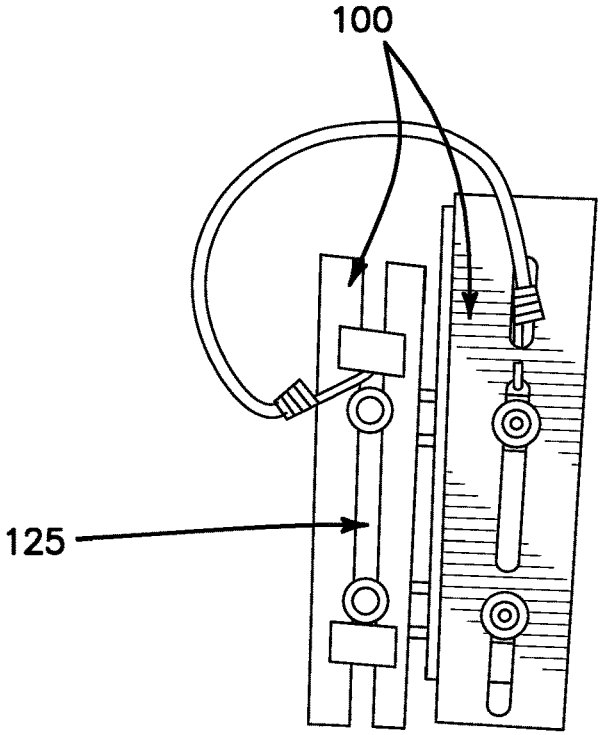
Figure 1D:
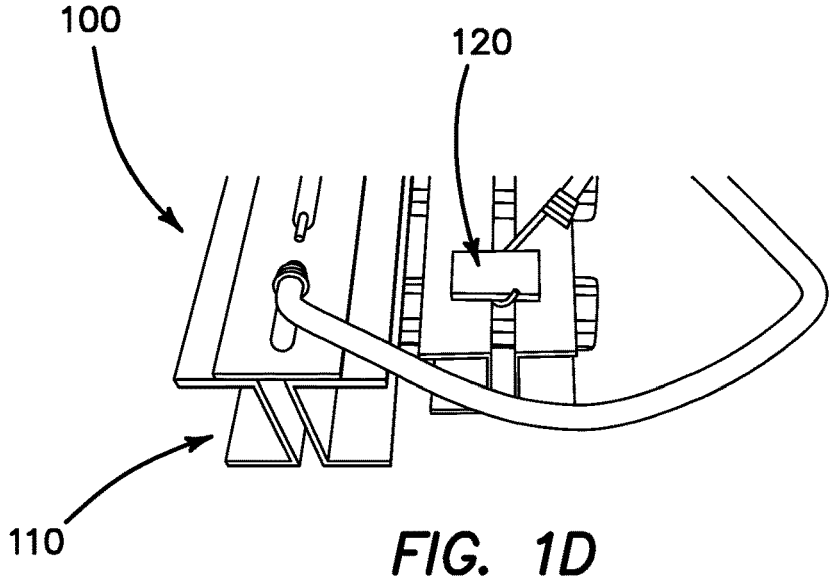
Figure 2:
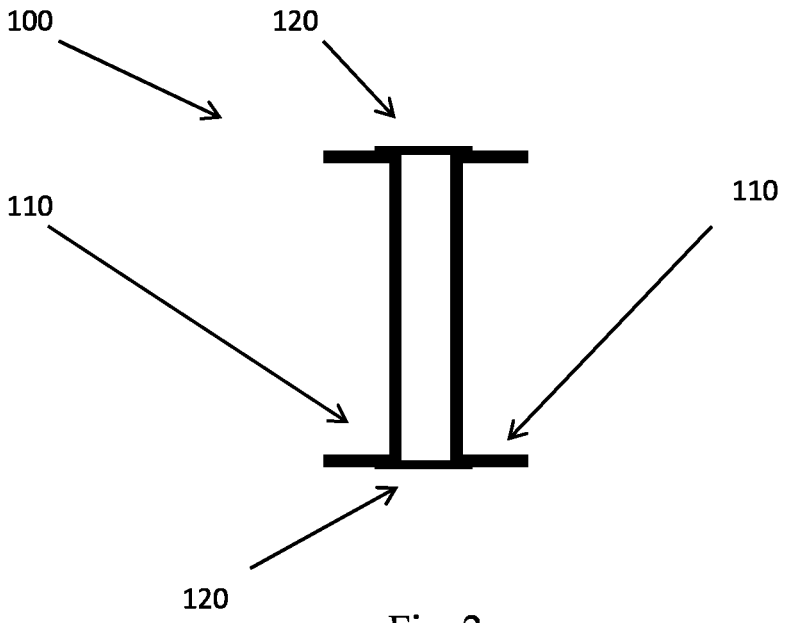
FIG. 2 illustrates an end view of a storage unit receiving track member according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The embodiments of the present invention, as described below in more detail, involve an overhead storage system comprising broadly a series of support rails attachable to an overhead structure (e.g., ceiling) and a series of storage unit receiving track members movably attachable to said support rails permitting the storage unit receiving track members to slide along the support rails changing the distance between neighboring storage unit receiving track members such that storage units of various sizes can be accommodated. The various components of the storage system detailed herein may be fabricated of any suitable materials including, but not limited to, metals, alloys, composites, woods, plastics, etc., and may be fabricated using any suitable technique including, but not limited to, machining, molding, machining and additive processes.

FIGS. 1A-1D and 2 show storage unit receiving track members 100. In one embodiment, the storage unit receiving track members 100 have an I-shaped cross-section. Two lower side ledges 110 serve to receive storage units as detailed below. One or more connector members 120 on the top and bottom hold the two halves together to form the I-shaped cross section. Openings 125 or slots in the top and bottom of the storage unit receiving track members 100 provide a passage for fasteners (e.g., bolts) suitable for movably attaching said storage unit receiving track members 100 to the supports rails 150.

Figure 3A:
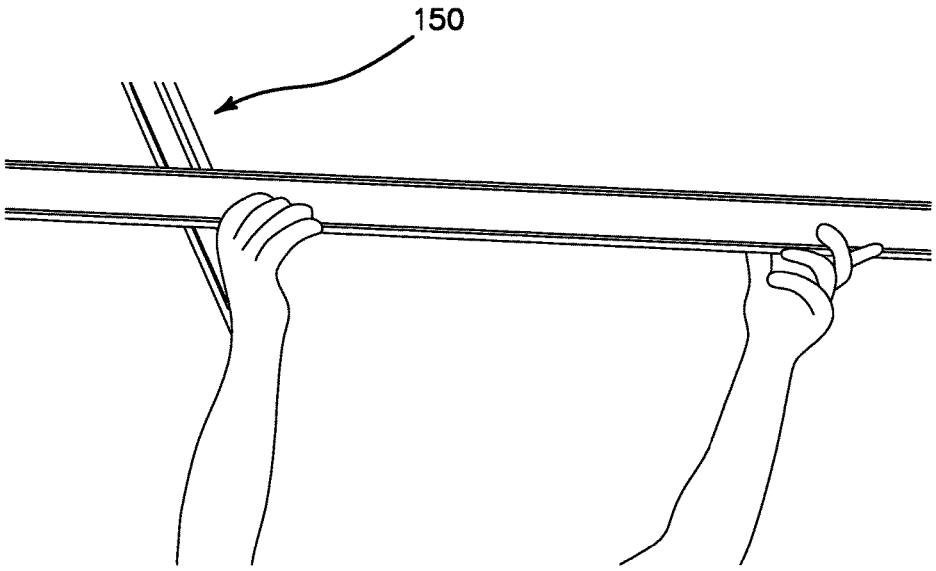
FIGS. 3A and 3B illustrates support rails attached to a ceiling according to the embodiments of the present invention.
Figure 3B:
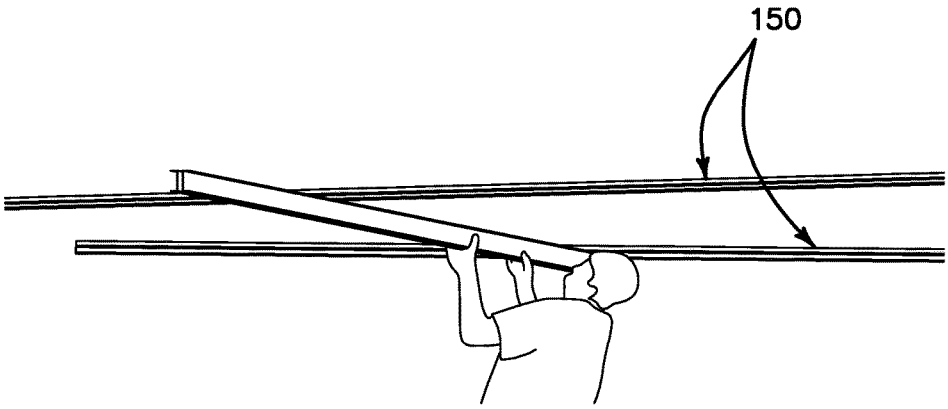
Figure 11:
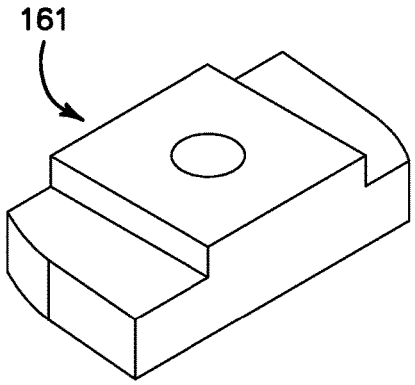
FIG. 11 illustrates a wheel for translating storage unit receiving track members according to the embodiments of the present invention.

FIGS. 3A and 3B illustrate support rails 150 attached to a ceiling according to the embodiments of the present invention. Attachment of the support rails 150 to the ceiling may be accomplished using any suitable fasteners such as screws, nails, staples, adhesive, etc. The support rails 150 define an internal track 155 configured to receive wheels 160 (see FIGS. 1A and 1B) which are able to translate along the length of the internal track 155. Bolts 165 pass through openings 125 in the top and bottom of the storage unit receiving track members 100 and into the threaded openings 170 in the wheels 160 such that the storage unit receiving track members 100 are able to translate along the length of said internal tracks 155. In this manner, the bolts 165 may be loosened allowing the storage unit receiving track members 100 to slide along the support rails 150 to accommodate storage units of various sizes. Tightening bolts 165 set the storage unit receiving track members 100 at the proper location along the support rails 150. While wheels 160 are described, it is recognized that other articles, such as rollers, bearings and similar roller mechanism may be used to translate the storage unit receiving track members 100 along internal tracks 155. FIG. 11 shows a roller article 161 of the type suitable to translate the storage unit receiving track members 100 along internal tracks 155.

Figure 4:
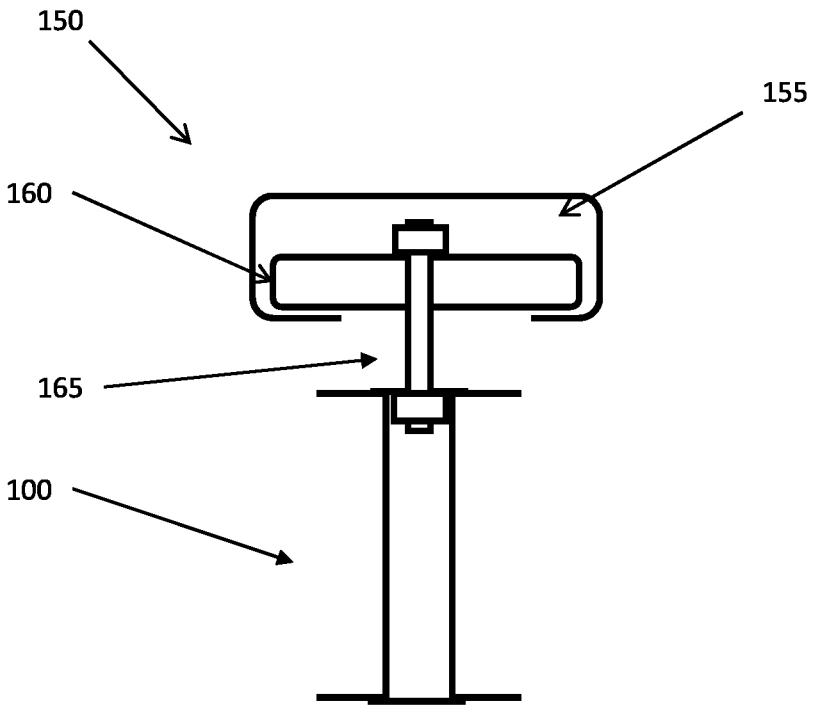
FIG. 4 illustrates an end view of a storage unit receiving track member connected to a support rail according to the embodiments of the present invention.

FIG. 4 illustrates an end view of a storage unit receiving track member 100 connected to the support rail 150 via fastener 165. As shown, the support rail 150 defines an internal track 155 having a generally C-shaped cross section. The wheel 160 is able to translate along the length of the internal track 155.

Figure 5A:
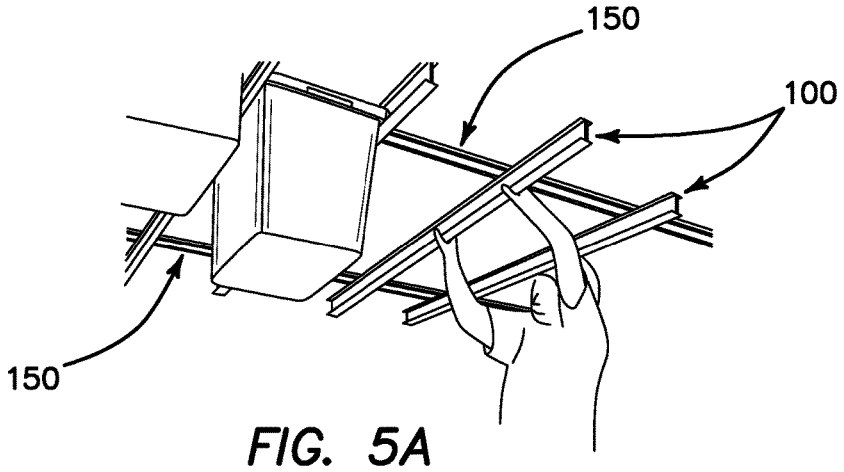
FIGS. 5A-5C illustrate storage unit receiving track members movably attached to support rails according to the embodiments of the present invention.
Figure 5B:
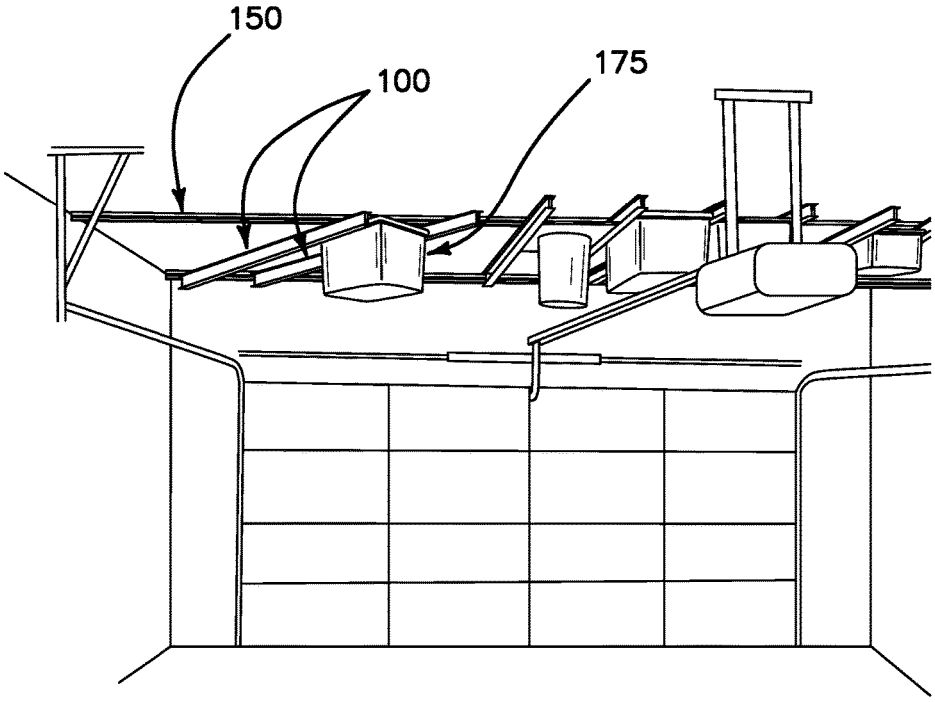
Figure 5C:
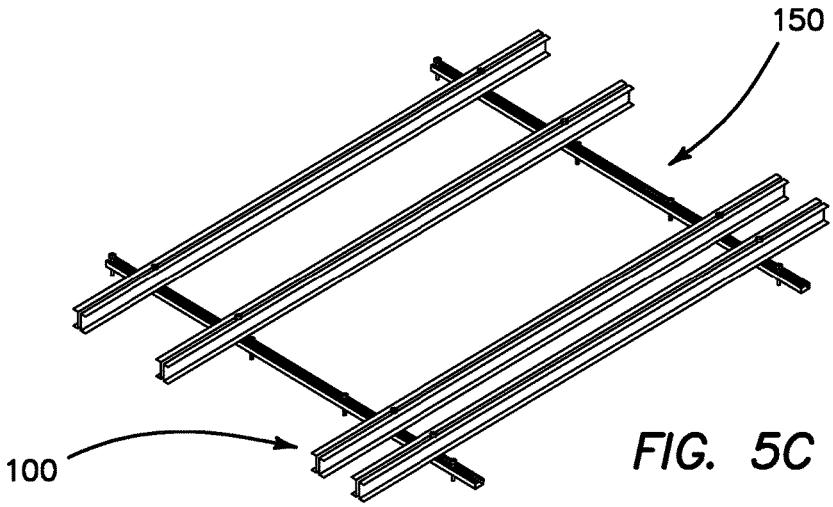
Figure 6A:
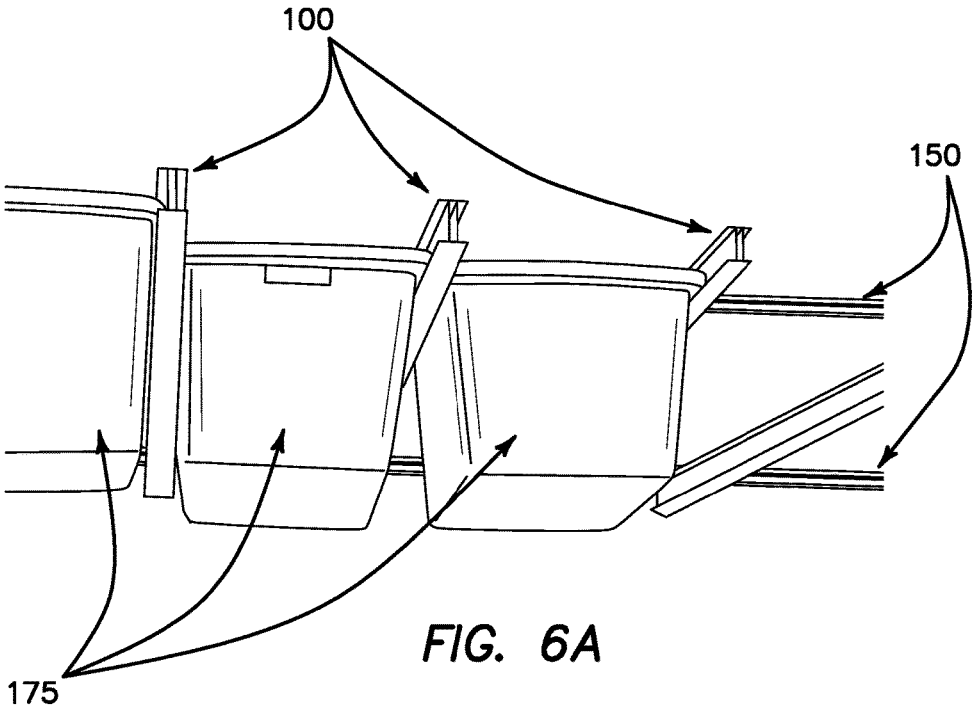
FIGS. 6A-6E illustrate various storage units hanging from said storage unit receiving track members according to the embodiments of the present invention.
Figure 6B:
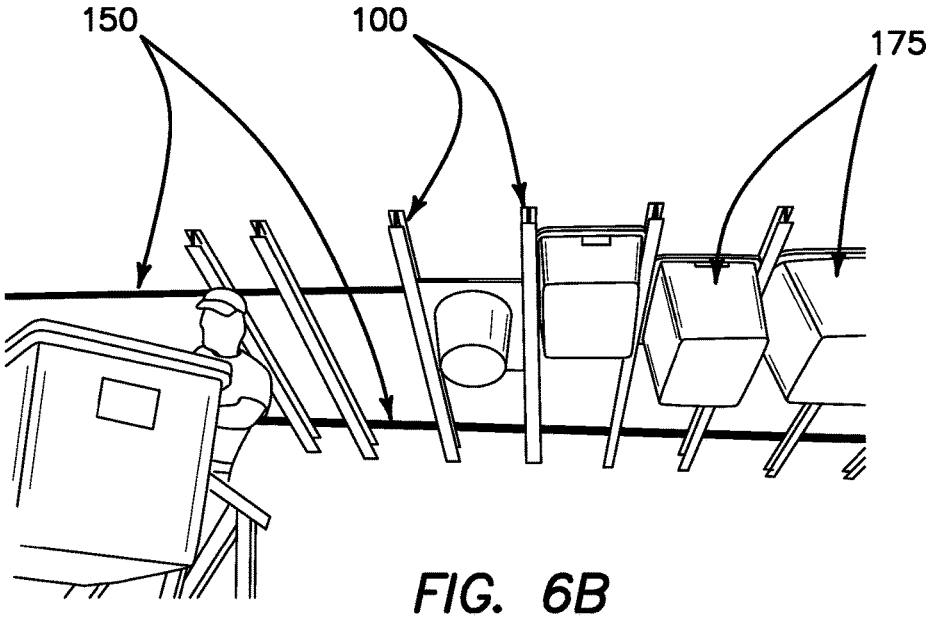
Figure 6C:
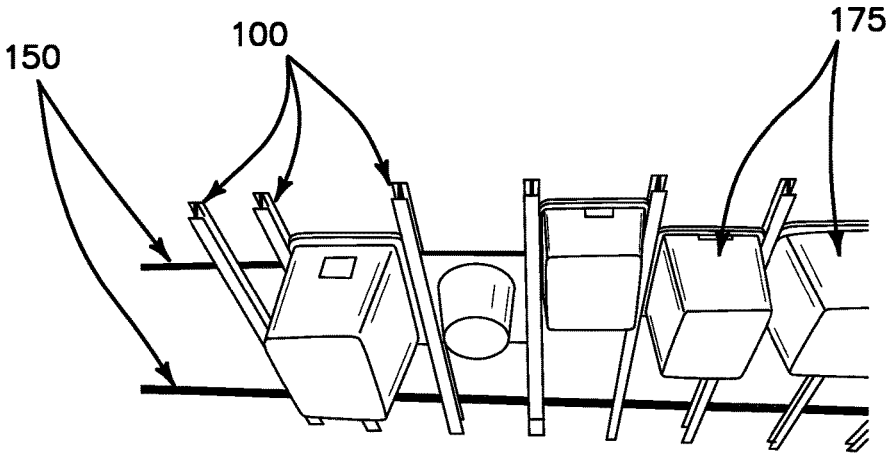
Figure 6D:
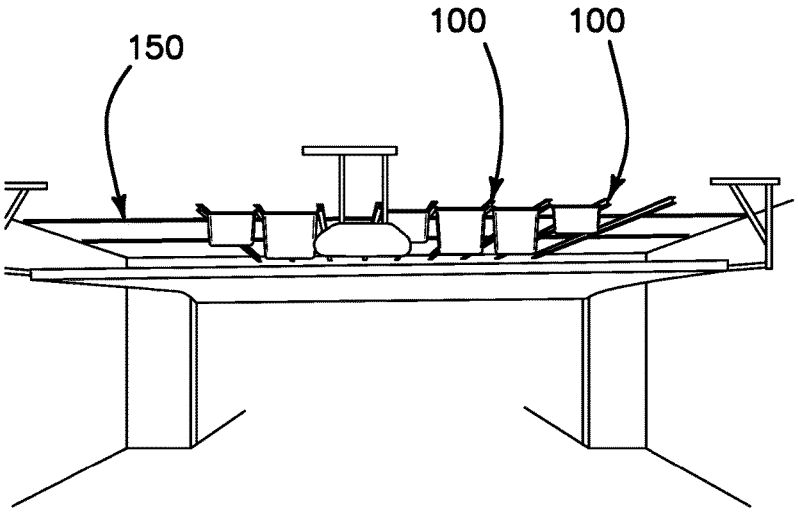
Figure 6E:
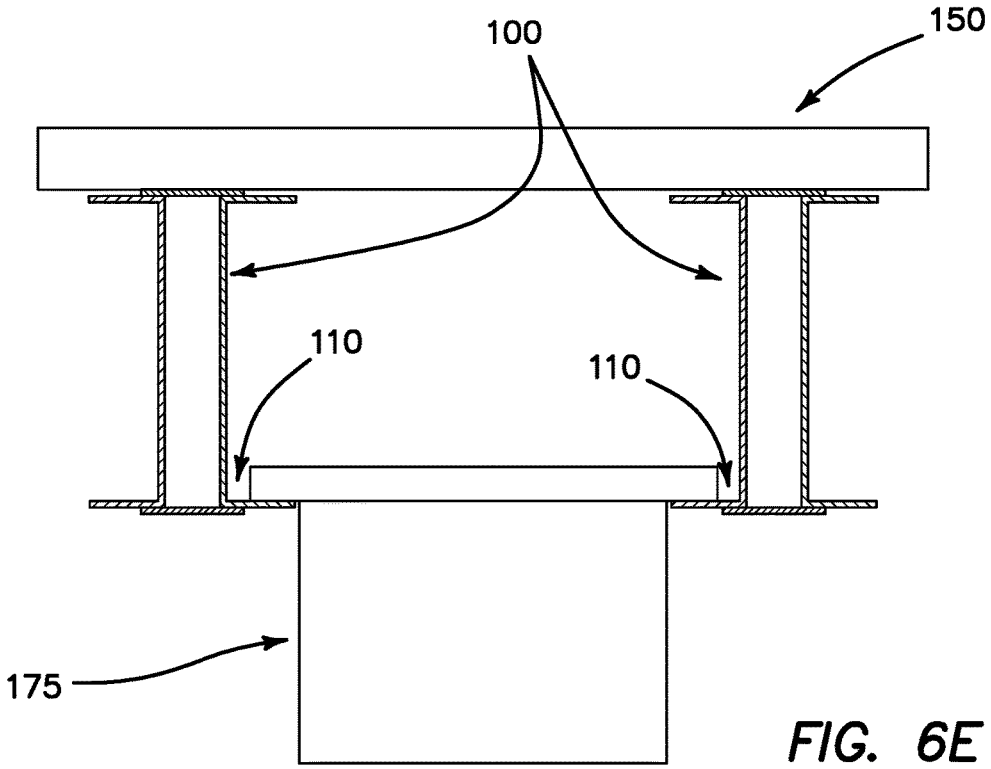

FIGS. 5A-5C illustrate storage unit receiving track members 100 movably attached to support rails 150 according to the embodiments of the present invention. In FIG. 5A, the storage unit receiving track members 100 are movably attached to the support rails 150 in a substantially orthogonal relationship. In FIG. 5B, the storage unit receiving track members 100 are movably attached to the support rails 150 in an angled relationship. FIGS. 6A-6D show various storage units 175 hanging from the storage unit receiving track members 100. FIG. 6E shows an end view of a storage container 175 hanging from a pair of storage unit receiving track members 100.

Figure 7A:
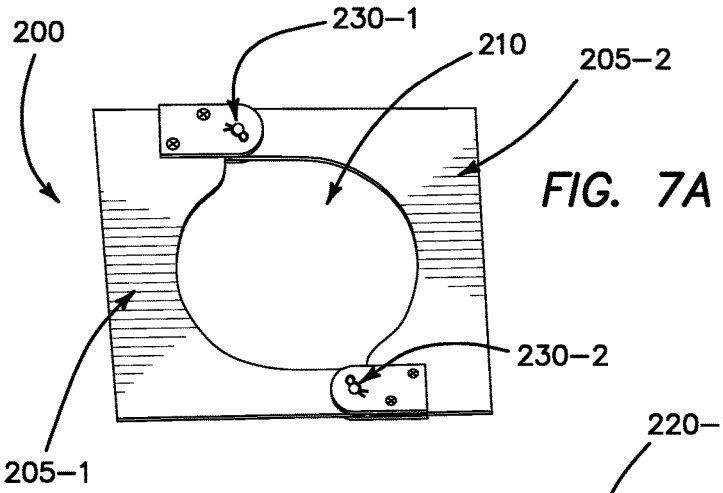
FIGS. 7A and 7B illustrate a bucket receiving member in closed and open positions, respectively, according to the embodiments of the present invention.
Figure 7B:
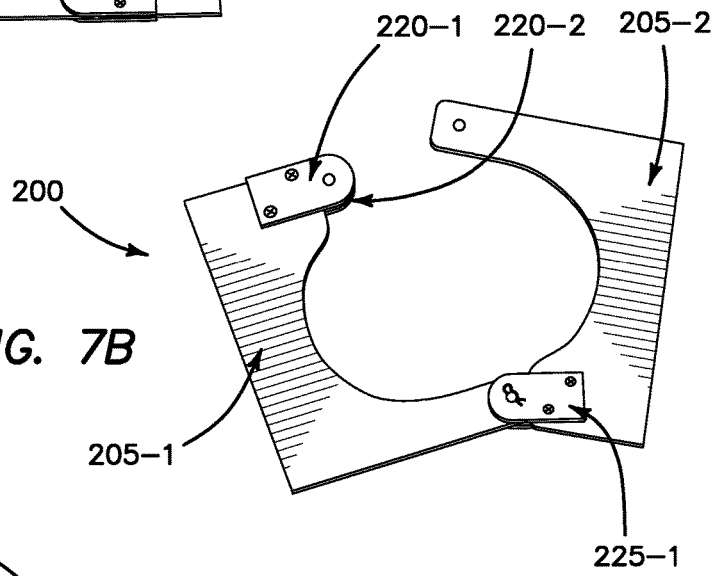
Figure 8A:
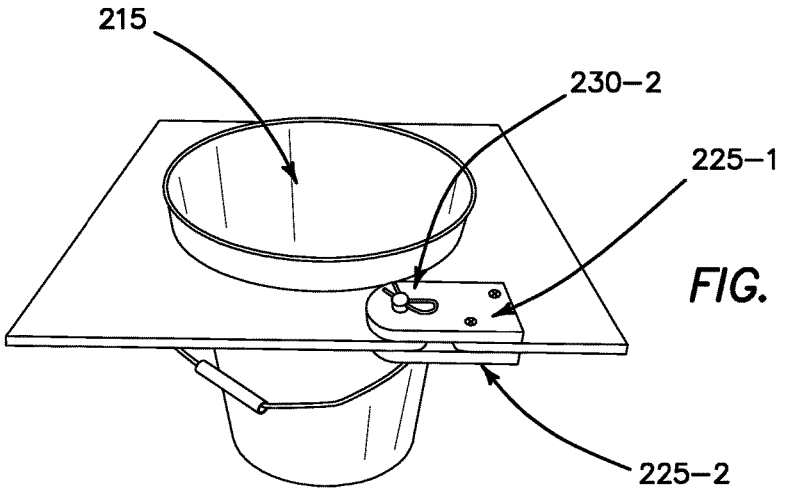
FIGS. 8A and 8B illustrate a bucket clamped by said bucket receiving member according to the embodiments of the present invention.
Figure 8B:
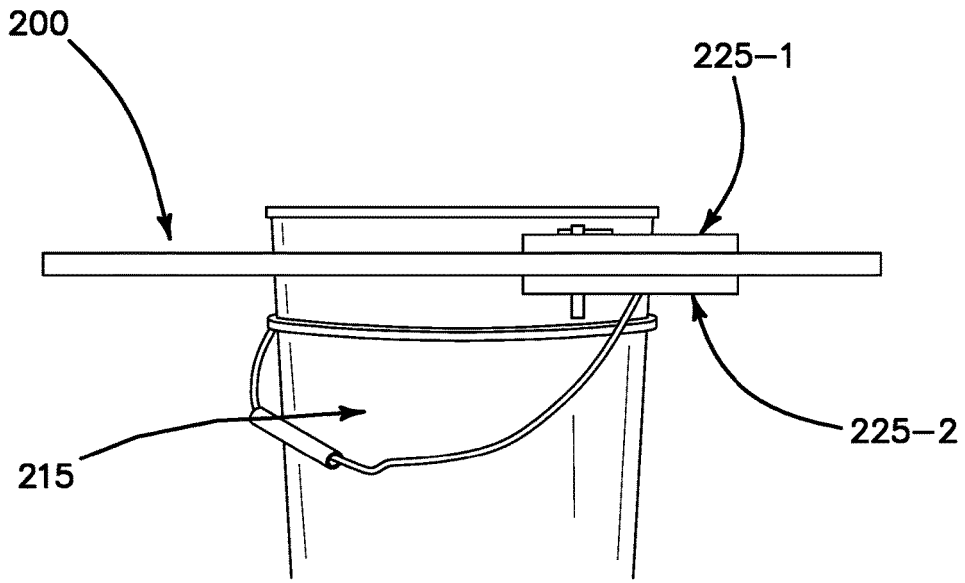

FIGS. 7A and 7B illustrate a bucket receiving member 200 in closed and open positions, respectively, according to the embodiments of the present invention. The bucket receiving member 200 includes two generally identical leafs 205-1 and 205-2 which when connected define a circular opening 210. In other embodiments, the two leafs may be any two paired parts (identical or not) which define a circular opening. The circular opening 210 is dimensioned to receive and retain a bucket 215 as shown in FIGS. 8A and 8B. Buckets of all sizes, including 1 to 10 gallon types may be attached using the bucket receiving member 200.

Figure 9:
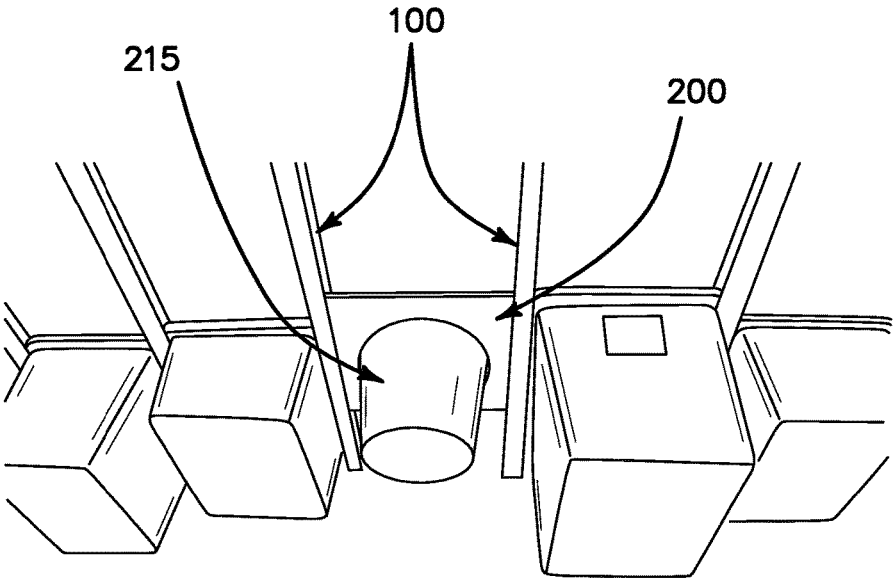
FIG. 9 illustrates a bucket receiving member inserted into the storage unit receiving track members according to the embodiments of the present invention.

In one embodiment, the two leafs 205-1 and 205-2 are joined to one another at two locations via common fasteners. As shown, a first pair of block members 220-1 and 220-2 and second pair of block members 225-1 and 225-2 are positioned on the first leaf 205-1 and second leaf 205-2, respectively, to accept an end portion of an opposite leaf. As shown, one of the block members 220-1 is attached to one side of the leaf 205-1 while the other block member 220-2 is attached to an opposite side of the block member 220-2. The same arrangement is true for leaf 205-2 and block members 225-1 and 225-2. The two connection points permit the bucket receiving member 200 to open and close as detailed below. In one embodiment, bolt and cotter pin combinations 230-1 and 230-2 join the two leafs 205-1, 205-2 to one another via the block members 220-1, 220-2, 225-1 and 225-2. Use of the bucket receiving member 200 involves disengaging one bolt and cotter pin combination allowing the two leafs 205-1 and 205-2 to rotate into an open position relative to each other about the opposite bolt and cotter pin combination thereby permitting the bucket receiving member 200 to clamp about one of the circumferential ridges proximate to the top of the bucket 215. Once the bucket 215 is positioned within the circular opening 210, the two leafs 205-1, 205-2 are closed and the bolt and cotter pin engaged to retain the bucket 215. FIG. 9 illustrates the bucket receiving member 200 inserted into the storage unit receiving track members 100.

In another embodiment, the block members may be attached to the same leaf as long as one leaf may be rotated about the other. The bucket receiving member may also be fabricated without the block members. For example, the leafs may be attached to one another directly using fasteners allowing rotation about one connection point when the other connection point is disengaged.

Figure 10A:
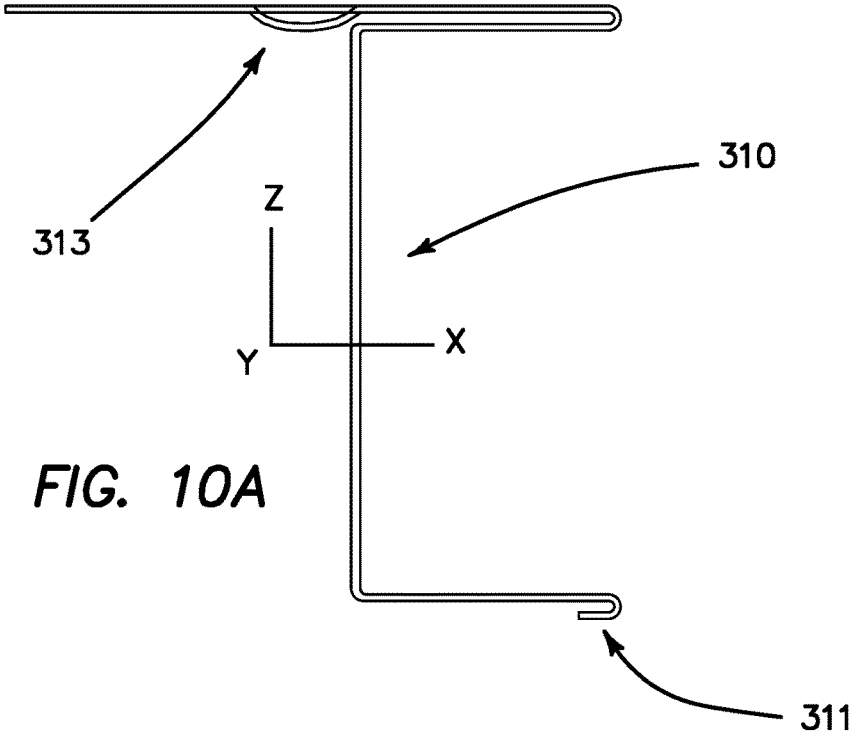
FIGS. 10A-10C illustrate an alternative embodiment of said storage unit receiving track members comprising three members according to the embodiments of the present invention.
Figure 10C:
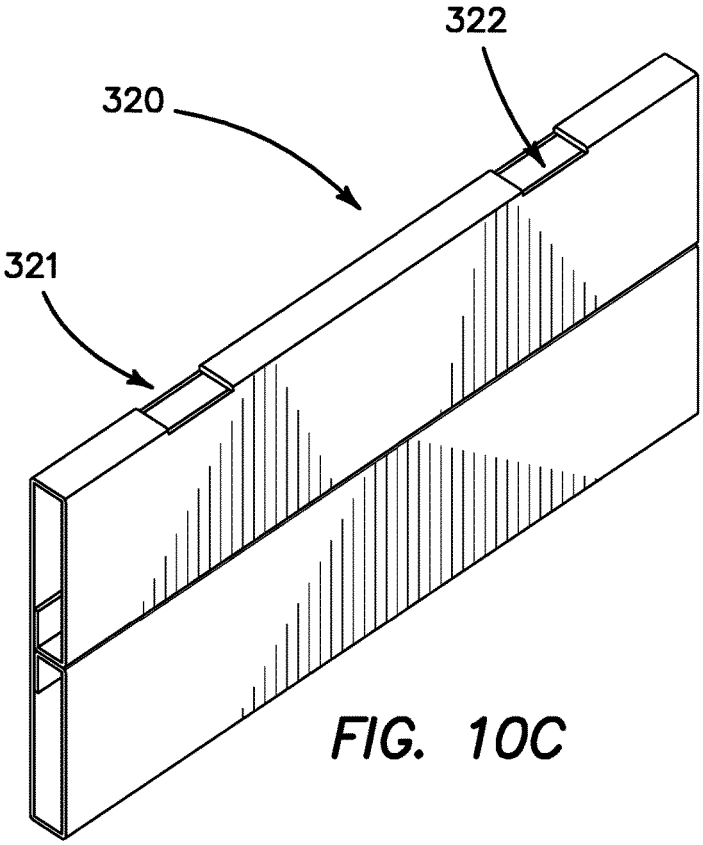
Figure 10B:
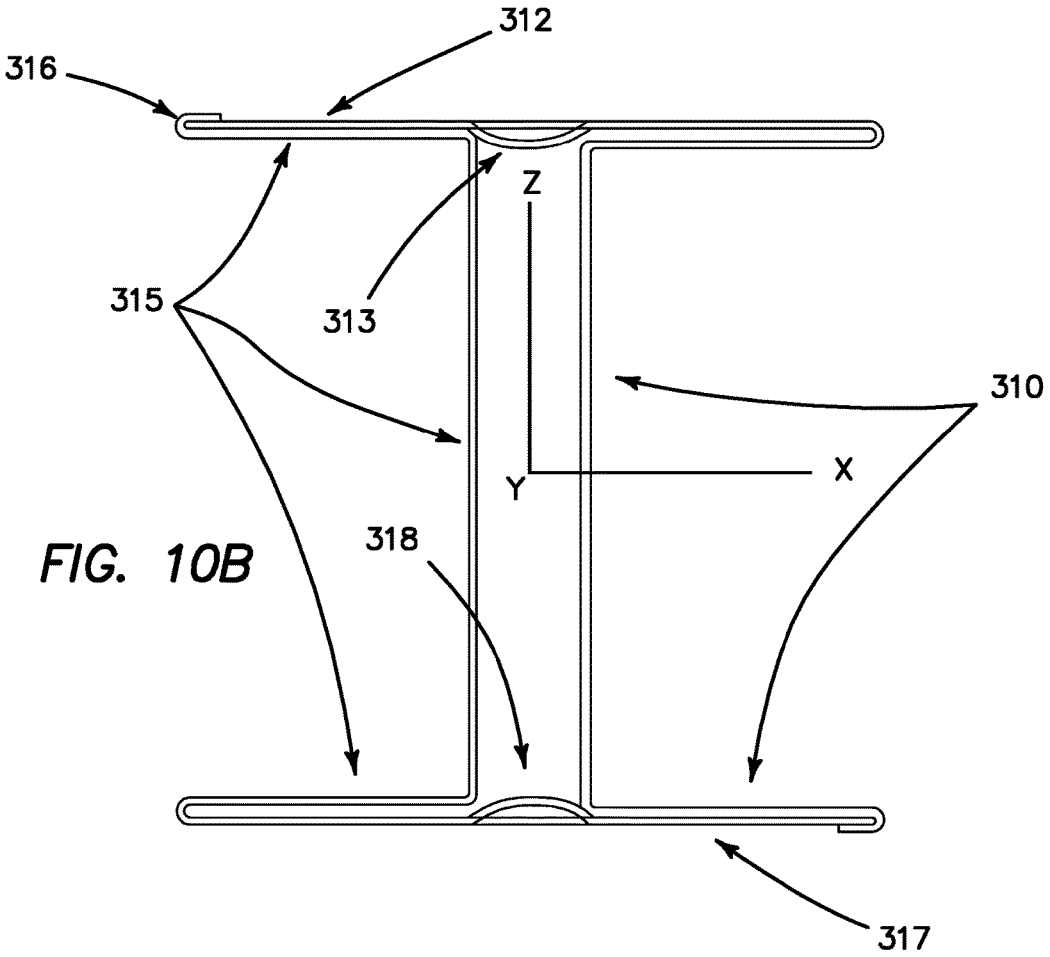

FIGS. 10A-10C show an alternative embodiment of a storage unit receiving track member 300 comprising three separate members according to the embodiments of the present invention. FIGS. 10A and 10B show ends of two elongated half members 310, 315 that join to form the I-shaped storage unit receiving track member 300. Half member 310 takes a generally T-shape while half member 315 takes a generally upside T-shape. The two half members 310, 315 mate via a pair of loops 311, 316 which receive a straight member 312, 317 of the opposite half member 310, 315. A splice member 320 may be used to further secure the two half members 310, 315. Spaced indents 313, 318 are positioned to insert into spaced openings 321, 322 in the splice member 320. In this embodiment, the storage unit receiving track member 300 is less burdensome to transport as it may be disassembled and reassembled easily.

Although the invention has been described in detail with reference to several embodiments, additional variations and modifications exist within the scope and spirit of the invention as described and defined in the following claims.

I claim:

1. A system comprising:

at least two support rails that are configured to be mounted to a ceiling, each of said at least two support rails define a length having a top surface, a bottom surface and a pair of opposed side walls, wherein a slot is formed in each bottom surface, wherein each slot extends the entire length of each of said at least two support rails respectively; and at least two storage unit receiving track members that slidably move along and selectively fix to said at least two support rails in a spaced apart relationship using a plurality of wheels; wherein each wheel has a center, an aperture located at the center, and a diameter;

wherein a first pair of wheels from said plurality of wheels are horizontally positioned in a first support rail from said at least two support rails between the opposed side walls of said first support rail with the center of each of the wheels from said first pair of wheels being parallel to and aligning with the slot in the bottom surface of the first support rail, and the first pair of wheels are closer to the bottom surface of the first support rail than the top surface of the first support rail;

wherein a second pair of wheels from said plurality of wheels are positioned horizontally in a second support rail from said at least two support rails between the opposed side walls of said second support rail with the center of each of the wheels from said second pair of wheels being parallel to and aligning with the slot in the bottom surface of the second support rail, and the second pair of wheels are closer to the bottom surface of the second support rail than the top surface of the second support rail;

a plurality of fasteners;

wherein a first pair of fasteners from said plurality of fasteners extends through a first storage unit receiving track member from said at least two storage unit receiving track members; wherein a first fastener from said first pair of fasteners extends through the slot of the first support rail and into a corresponding aperture of a first wheel from said first pair of wheels within the first support rail; wherein a second fastener from said first pair of fasteners extends through the slot of the second support rail and into a corresponding aperture of a second wheel from said second pair of wheels within the second support rail to suspend the first storage unit receiving track member from the first support rail and the second support rail;

wherein a second pair of fasteners from said plurality of fasteners extends through a second storage unit receiving track member from said at least two storage unit receiving track members; wherein a third fastener from said second pair of fasteners extends through the slot of the first support rail and into a corresponding aperture of a third wheel from said first pair of wheels within the first support rail; wherein a fourth fastener from said second pair of fasteners extends through the slot of the second support rail and into a corresponding aperture of a fourth wheel from said second pair of wheels within the second support rail to suspend the second storage unit receiving track member from the first support rail and the second support rail;

wherein each fastener from said first and second pair of fasteners is configured to be tightened to maintain the first and second storage unit receiving track members at a fixed location with respect to the first and second support rails;

wherein each of said at least two storage unit receiving track members are I-shaped defining side ledges;

wherein, when in use, an upper portion of a storage unit is configured to extend into a corresponding pair of opposed side ledges from the side ledges of adjacent storage unit track members from said at least two storage unit track members to suspend the storage unit from the ceiling; wherein, when in use, the storage unit comprises a container and a lid.

2. The system of claim 1 wherein said at least two storage unit receiving track members are further configured to slidably attach to said at least two support rails such that a distance between said at least two storage unit receiving track members may be adjusted to accommodate storage units of varied sizes.

3. The system of claim 1 wherein said at least two storage unit receiving track members are each formed of two half members that attach to one another to form the general I-shape.

4. A system comprising:

at least two support rails that are configured to be mounted to a ceiling, each of said at least two support rails having a top surface, a bottom surface and a pair of opposed side walls, wherein a slot is formed in said bottom surface of each of said at least two support rails; and at least two storage unit receiving track members that slidably move along and selectively fix to said at least two support rails in a spaced apart relationship using a plurality of wheels; wherein each wheel has a center, an aperture located at the center, and a diameter;

wherein a first pair of wheels from said plurality of wheels are horizontally positioned in a first support rail from said at least two support rails between the opposed side walls of said first support rail with the center of each of the wheels from said first pair of wheels being parallel to and aligning with the slot in the bottom surface of the first support rail, and the first pair of wheels are closer to the bottom surface of the first support rail than the top surface of the first support rail;

wherein a second pair of wheels from said plurality of wheels are positioned horizontally in a second support rail from said at least two support rails between the opposed side walls of said second support rail with the center of each of the wheels from said second pair of wheels being parallel to and aligning with the slot in the bottom surface of the second support rail, and the second pair of wheels are closer to the bottom surface of the second support rail than the top surface of the second support rail;

a plurality of fasteners;

wherein a first pair of fasteners from said plurality of fasteners extends from a first storage unit receiving track member from said at least two storage unit receiving track members; wherein a first fastener from said first pair of fasteners extends through the slot of the first support rail and into a corresponding aperture of a first wheel from said first pair of wheels within the first support rail; wherein a second fastener from said first pair of fasteners extends through the slot of the second support rail and into a corresponding aperture of a second wheel from said second pair of wheels within the second support rail to suspend the first storage unit receiving track member from the first support rail and the second support rail;

wherein a second pair of fasteners from said plurality of fasteners extends from a second storage unit receiving track member from said at least two storage unit receiving track members; wherein a third fastener from said second pair of fasteners extends through the slot of the first support rail and into a corresponding aperture of a third wheel from said first pair of wheels within the first support rail; wherein a fourth fastener from said second pair of fasteners extends through the slot of the second support rail and into a corresponding aperture of a fourth wheel from said second pair of wheels within the second support rail to suspend the second storage unit receiving track member from the first support rail and the second support rail;

wherein each fastener from said first and second pair of fasteners is configured to be tightened to maintain the first and second storage unit receiving track members at a fixed location with respect to the first and second support rails;

wherein each of said at least two storage unit receiving track members are I-shaped defining side ledges;

a bucket receiving member comprising two leaf member which are rotatably connected to each other, wherein a circular opening is defined between the two leaf members, and the circular opening is configured to retain a bucket therein;

wherein, when in use, the bucket receiving member and an upper portion of a storage unit is configured to extend into a corresponding pair of opposed side ledges from the side ledges of adjacent storage unit track members from said at least two storage unit track members to suspend the bucket receiving member and the storage unit from the ceiling; wherein, when in use, the storage unit comprises a container and a lid.

5. The system of claim 4 wherein said at least two storage unit receiving track members are each formed of two half members that attach to one another to form the general I-shape.

6. The system of claim 4 wherein said at least two storage unit receiving track members are further configured to slidably attach to said at least two support rails such that a distance between said at least two storage unit receiving track members may be adjusted to accommodate storage units of varied sizes.

* * * * *